United States Patent [19]

Pensavecchia et al.

[11] Patent Number: 4,828,416

[45] Date of Patent: May 9, 1989

[54] VERTICAL STAND-ALONE PRINTER

[75] Inventors: Frank Pensavecchia, Lake Orion, Mich.; John R. Morrison, Hollis; Neil D. Kleinfeld, Bedford, both of N.H.

[73] Assignee: Genicom Corporation, Waynesboro, Va.

[21] Appl. No.: 37,137

[22] Filed: Apr. 10, 1987

Related U.S. Application Data

[63] Continuation of Ser. No. 754,068, Jul. 11, 1985, abandoned.

[51] Int. Cl.[4] ..... B41J 11/58

[52] U.S. Cl. ..... 400/624; 400/629; 400/691

[58] Field of Search ..... 400/636.2, 624, 708, 400/708.1, 624, 625, 629, 691, 692, 693, 605; 271/8, 110, 113, 116, 242, 127, 4, 178, 8.1, 9, 10, 109, 145, 278, 207

[56] References Cited

U.S. PATENT DOCUMENTS

| | | | |
|---|---|---|---|
| 2,366,206 | 1/1946 | Metzner | 400/629 X |
| 4,089,402 | 5/1978 | Hyland et al. | 400/625 |
| 4,193,483 | 3/1980 | Ariga et al. | 400/625 X |
| 4,268,021 | 5/1981 | Ratishauser et al. | 400/625 X |
| 4,416,559 | 11/1983 | Steinhilber | 400/629 |
| 4,452,543 | 6/1984 | Adkisson et al. | 400/625 X |
| 4,560,156 | 12/1985 | Dubois | 400/625 |
| 4,565,462 | 1/1986 | Yamamoto et al. | 400/629 X |
| 4,634,304 | 1/1987 | Narushima et al. | 400/691 |
| 4,652,161 | 3/1987 | Crean et al. | 400/629 |
| 4,674,899 | 6/1987 | Kimura | 400/605 |

FOREIGN PATENT DOCUMENTS

| | | | |
|---|---|---|---|
| 42674 | 4/1981 | Japan | 400/625 |
| 39573 | 3/1984 | Japan | 400/625 |
| 185676 | 10/1984 | Japan | 400/629 |

*Primary Examiner*—David A. Wiecking
*Attorney, Agent, or Firm*—Nixon & Vanderhye

[57] ABSTRACT

A bottom-weighted, free-standing, self-contained, self-supported printer in which the printer is provided with two vertical hoppers in spaced-apart adjacency, with the first hopper to house a supply of cut paper and with the second hopper for paper retrieval in a first in/first out (FIFO) sequence, in which the printer has an exceedingly small footprint so that it may be utilized adjacent the display for a personal computer. Various features include an L-shaped structure to house various size printing assemblies; bottom weighting for stability; electronics carried between the hoppers; an optional front opening for paper retrieval from the front of the printer; a combination of a bidirectional motor and unidirectional clutches for driving picker and exit rollers as well as the platen; a specialized paper guide; an alternative paper path for cut or continuous paper sheets to provide a "limp mode" operation; a paper leading and trailing edge sensor; and swing way sides for easy access to hoppers and printing apparatus.

38 Claims, 7 Drawing Sheets

VERTICAL STAND-ALONE PRINTER

This is a continuation of application Ser. No. 754,068, filed July 11, 1985, now abandoned.

FIELD OF THE INVENTION

This invention relates to printers and more particularly to a free-standing printer for use with computers or other like devices in which the printer is free-standing and occupies a minimum amount of space while accommodating both relatively inexpensive precut paper as well as continuous form paper is desired.

BACKGROUND OF THE INVENTION

Current personal computers include some sort of keyboard entry device, a central processing and disc drive unit and a monitor usually involving the use of a cathode ray tube (CRT). In the case of word processing, printed text or material is presented on the CRT screen, is edited and is then printed by a printer which in general is a horizontally-oriented device which takes up a considerable amount of space and which utilizes fan-folded or sprocket-fed continuous sheets of paper which require physical room for input and output stocks. There is also great paper waste for leading and trailing paper leaders. Moreover, it is only with great difficulty that these printers can be made to utilize low cost bond and copier paper, and cut sheet jam ups in such a machine require virtually disassembling the entire unit in order to clear the jam. The horizontal printing units resemble flat typewriters without a keyboard and are exceptionally heavy and unweildly such that they must be placed on an adjacent table, or the work station must be significantly enlarged in order to accommodate the printer. More often than not the printer is located away from the typing work station which makes viewing of the print out inconvenient for the operator in that the operator must move from the typing station to the printout station, especially if pre-cut sheets of paper are utilized.

By way of further background, one type of apparatus for feeding sheets of paper from a magazine into a printing office machine is shown in U.S. Pat. No. 4,248,415 in which detachable angled paper magazines are utilized with a separate already existing printer. This patent is thus directed to a printer add-on and not to a stand-alone self-contained printer. In this patent the counter rotation of a printer platen squares paper when paper is fed from a magazine into a platen by virtue of a picker roller. It will be appreciated that in this patent vertical hoppers are not used and that there is no specification of how the paper is withdrawn from the collection bin. Moreover, the utilization of paper magazines introduces a level of complexity and additional parts which in general result in a more expensive machine. Thirdly should there be a machine jam-up or in time "wearout", there is no alternative paper for path feeding paper into the printing mechanism should the picker mechanism malfunction. Thus there is no so called "limp mode" operation. Also, the platen and picker rollers are belt driven which suffers from belt stretch and breakage. Finally, the provision of electronics between hoppers is neither shown nor taught in this patent and bottom weighting of the device to provide a small-footprint, free-standing, self-contained printer is not discussed. Other feeding devices for printers, but none constituting a stand-alone printer, include U.S. Pat. Nos. 2,366,206; 3,776,545 and 4,089,402. It will be noted that each of these devices is made for attachment to an already existing device and mainly relate to sheet feeding as opposed to a stand-alone printer configuration.

SUMMARY OF THE INVENTION

In the subject invention rather than providing a horizontally-oriented printer, or even one with angled magazines, a vertically-oriented self-contained, stand-alone printer is utilized which is bottom-weighted by the printing apparatus and has a small footprint particularly in the width direction, so that it may be used directly beside the monitor or CRT utilized for a personal computer. Note. it is the width dimension of conventional printers that results in the need for a wider table. The subject printer is free-standing and stable and has, in one embodiment, a toaster-like configuration in that vertically oriented and spaced-apart input and exit hoppers are utilized. The input and exit slots of the respective hoppers are at the top of the unit and resemble the openings of the conventional toaster. In one embodiment the exit slot is opened at the front of the unit facing the operator to provide a forward facing slot from which to remove printed sheets. This front access permits the printer to be located on a shelf with a shelf immediately above.

In operation, paper is loaded into the printer through the input slot where it is stored within the printer in the input hopper. In order to facilitate paper loading in one embodiment this side of the hopper is outwardly swingable to permit loading of cut paper. In another embodiment paper loading occurs from the top so that space need not be allocated to a swing away side. The printer is provided with a picker roller driven by a one way clutch and a bidirectional motor. The picker roller picks a sheet of stored paper and moves it downwardly, where it is curved by a guide into the nip between a cylindrical platen and a mating pinch roller or rollers. In one embodiment the platen is driven by the bidirectional stepping motor through a one way clutch so that the platen only moves in the drive direction. In another embodiment reversing motion of this platen is prevented which presents a non-moving nip between the platen and a mating pinch roller when the motor drives the picker roller. This permits paper squaring against the nip between the platen and pinch roller.

When the paper reaches the platen and has been squared, the bidirectional motor is reversed, thus driving the unidirectional clutches for the exit roller and the platen. In summary, the same motor drives the platen, the exit roller and the pick roller. Thus the bidirectional motor may be actuated to drive the platen so that it permits printing which is accomplished either at the platen or between the platen and the bottom of the exit hopper.

Note that in one embodiment for bulky printing apparatus, all the printing apparatus is located in the rightwardly extending L portion at the base of the unit to give it stability during printing. This provides a free standing operation with a minimum lateral area being occupied by the printer. Alternatively for some print heads the unit need not extend to the right to provide an "L". Moreover, since the unit can accommodate low cost bond copy paper, the paper is compatible with both personal computer type printing applications, copying type applications and the typewriter of a small business or home.

Because of the particular orientation of the printer, opening of the exit hopper side of the printer exposes the entire printing mechanism such that paper jams, should they occur, are easily cleared. Ribbon and print head change are also accomplished through this opening.

Additionally, the input hopper side of the case is optionally provided with a slot to permit insertion of either continuous paper or cut paper into the nip between the platen and the pinch roller to provide an alternative paper path which may also be utilized should the drive system for the input hopper be disabled or malfunctioning. This provides that paper can be fed into this slot and through the printer regardless of whether the input hopper and associated drive mechanism are operating properly. Thus the alternative paper path provides for a limp mode of operation.

In one embodiment, at least two one-way clutches are coupled to allow the drive motor to do both the job of picking paper and driving the exit roller. When the motor is driven in one direction power is applied to the picker shaft and the exit roller shaft overruns or slips. Hence one motor accomplishes at least two functions. If the platen is also to be driven by this one motor, in one embodiment, a one way clutch mechanism is inserted between the platen drive shaft and the motor drive shaft so that one motor provides three functions.

As mentioned before, in order to be sure that the platen picks up the paper reliably, the paper is overdriven into a curved shape by the picker roller. This curved shape results in the paper attempting to spring into the platen. When the platen begins to rotate in the drive direction the spring force paper urges the paper in the drive direction, thereby assisting the pickup action that occurs between the platen and the pressure rollers.

Any one of a number of printheads or printing assemblies may be utilized in conjunction with this particular unit including impact printers, ink jet printers, thermal printhead printers and electrostatic printers, should such be desired.

Further, one embodiment, the controller and input/output (I/O) electronics for the feeding and printing operation is carried on circuit boards positioned between the two hoppers, thereby eliminating the need for additional space for the electronics. Also since the electronics are relatively light, and are carried by light circuit boards, locating the circuit boards between the hoppers does not unbalance the vertical printer since the relatively heavy printing components and drive assemblies have been located at the bottom of the unit.

In summary, a free-standing, self-contained, vertical-hopper "toaster" configuration, self-supported printer is provided in which the printer has two adjacent spaced-apart vertical hoppers for cut paper feed and FIFO paper retrieval, with the paper retrieval hopper having a front as well as top slot in one embodiment. The electronics and boards are mounted between the hoppers, such that the printer is bottom weighted by the printing apparatus and thus has an exceedingly small footprint so that it may be utilized adjacent the display for a personal computer. Paper, in the form of cut sheets, is stored in one of the vertical hoppers and is picked a piece of a time and moved downwardly around a cylindrical platen and then upwardly towards the direction of the exit hopper, with the printing being accomplished either as the paper moves around the platen, or afterwards as the paper moves over a printhead which is positioned between the platen and the exit roller. The picker roller is utilized to move the paper from storage in the input hopper to a printing position, and is driven directly by a bidirectional motor and a specialized clutch assembly which in one mode drives the picker roller, with the platen braked and the exit roller running; whereas in the reverse direction the motor drives the platen and the exit roller during the printing operation. A curved guide is provided so that the downwardly moving paper enters into the nip between the platen and associated pressure roller or rollers with the curvature of the paper after the platen being maintained by the curved guide until the paper reaches the printhead position. A leading trailing edge paper sensor is utilized in one embodiment to sense the beginning and end of a cut sheet of paper so that the printhead may be actuated to print the paper. In this embodiment the paper sensor provides for an auto load and an auto unload capability, such that the forms need not be printed on costly fan-folded or sprocket-fed forms, with the paper sensor sensing the beginning and end of a cut sheet. The paper in the output hopper is in a first in/first out sequence.

In an alternative paper path embodiment the curved guide is provided with a curved lip adjacent to a slot in the side of the printer case for the feeding of continuous sprocket-fed or fan folded paper into the nip. Thus continuous paper feed may be provided, or alternatively cut sheets can be fed along this alternative paper path.

Because of the vertical orientation of the printer and its L shape, in one embodiment with the printing apparatus at the base of the unit, the printer is weighted at its base by the printing apparatus, motors and associated carriage drive units. The unit is therefore mechanically stable though free standing and has a small footprint. In one embodiment, the vertical free-standing configuration allows for jam removal by the swinging away of both the input hopper side and the exit hopper side of the printer which exposes all necessary parts for jam removal and printer part interchange. The swing away aspect is advantageous when non-specified or inferior paper is used which papers tends to cause jams.

The printing element may either be located adjacent to the platen to use it as an impact anvil, or the printing may be performed after the paper leaves the platen. Moreover, the bottom portion of the printer which forms the "L" may be made longer or shorter to accomodate different size printing systems without disturbing the feed or drive circuitry. Also the "L" shaped bottom permits access for ribbon change, daisy wheel change, or font change without access to other parts of the printer. Of course the right hand side of the upper part of the case can be extended to give a more box-like configuration, thus eliminating the necessity for the L-shaped configuration.

BRIEF DESCRIPTION OF THE DRAWINGS

These and other features of the subject invention will be better understood in conjucntion with the Detailed Description taken in conjunction with the drawings of which.

DETAILED DESCRIPTION

Figure 1A:
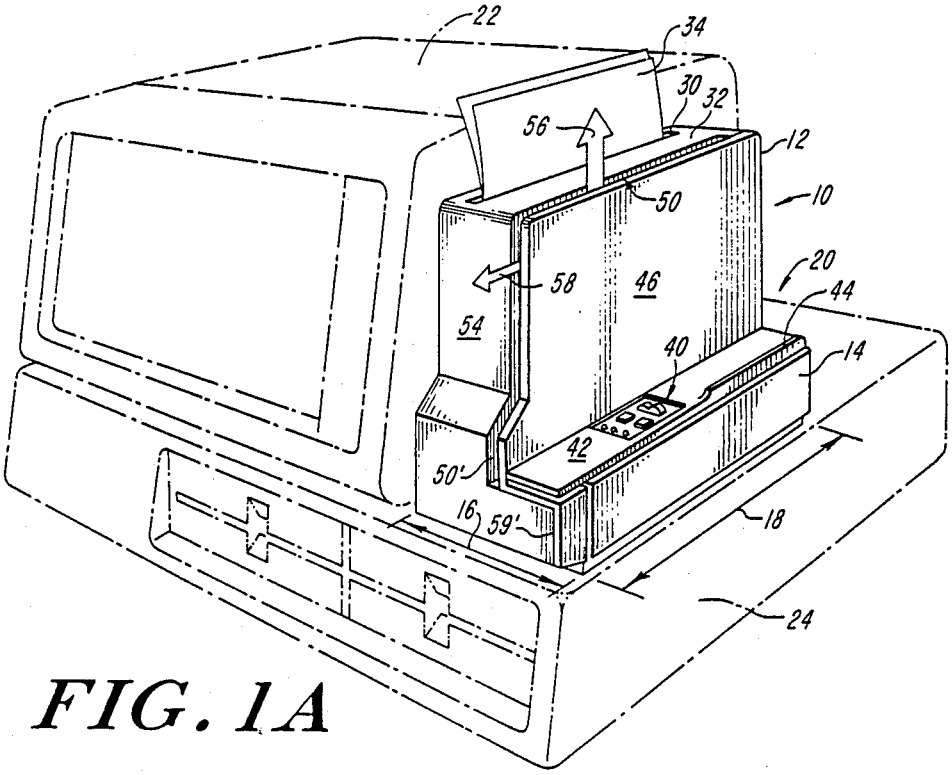
FIGS. 1A and 1B are isometric views of the subject stand-alone, vertically-oriented printer illustrating its relatively small footprint as it resides on top of a portion of a personal computer, as well as its optional swing away exit hopper side used to expose the printing apparatus contained therein.

Referring now to FIG. 1A, a free-standing, vertically-oriented printer 10 is illustrated as having a vertically upstanding portion 12 and a rearwardly running portion 14 which defines the depth of the unit that runs from front to back at the right side of the printer to give the appearance of an L-shaped structure having a footprint illustrated by double-ended arrows 16 and 18 to be relatively small compared to the personal computer generally illustrated by dotted outline 20 to include a display 22 resting atop a dual disc drive unit 24.

Figure 2:
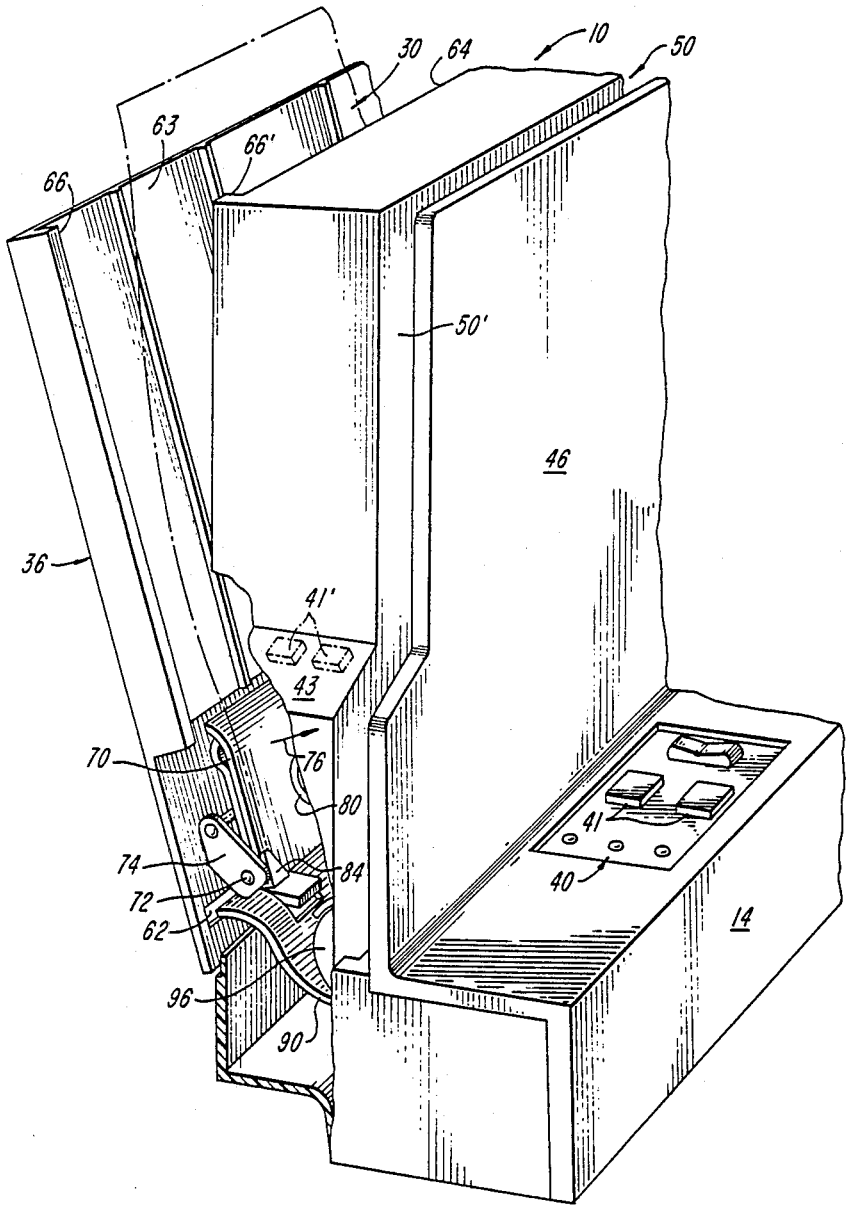
FIG. 2 is a diagramatic and partial sectional view of the subject printer illustrating the optional swinging open of the input hopper side of the unit permit the insertion of paper into the input hopper.

As can be seen from this figure, the printer has an input slot 30 in its top surface 32 to permit the insertion of paper 34 therethrough and into the printer's input hopper as will be described hereinafter. Also as will be described hereinafter, a side portion (left side surface) generally indicated by reference character 36 and as illustrated in FIG. 2 is allowed in one embodiment to swing away from the main body of the unit, also to permit the insertion of cut sheets of paper. An alternative version allows insertion without opening of the input hopper.

Referring back to FIG. 1A, it can be seen that the cut sheets of paper may extend above the top surface 32 of the printer such that the length of paper utilized by the printer is not restricted to any given vertical length. Thus the printer can accommodate letter size and legal size paper with ease. A narrow finger slide (not shown) is provided in one embodiment to prevent input and output paper droop for long legal forms.

The printing is accomplished under the command of internal electronics driven by, for instance, the output of a personal computer or even a dedicated word processor. Controls for such printing are generally indicated by reference character 40 to be on the top surface 42 of the L-shaped portion of the printer which extends to the right. Alternatively these controls can be mounted at the front of the printer for easy access, should the shelf provided by the L be used for storage. Moreover, if the controls are push buttons 41 mounted on angled surface 43 of FIG. 2 of the front of the printer, pressing a button will not move the printer rearwardly. Referring back to FIG. 1A, a ledge 44 is provided such that discs for the disc drive or firmware manuals may be stored upstandingly along right side surface 46 of the printer.

Figure 1B:
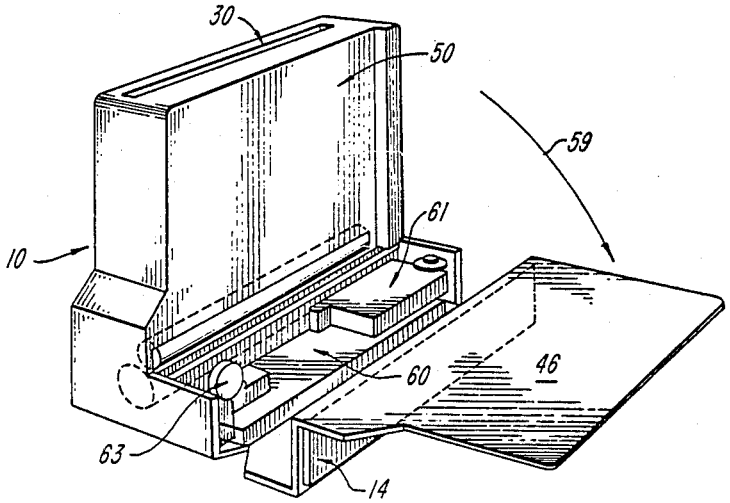

The cut sheet or other printed material is collected in FIFO order in an exit hopper having an exit slot 50 in top surface 32 which, in one embodiment, is extended down front face 54 of printer 10 as exit slot 50'. Thus the exit hopper is exposed through a slot which runs from the top surface and down the front side so that paper may be removed in the direction either of arrow 56 or arrow 58. The significance of the vertically running front slot 50' is that paper may be removed in the direction of the operator so that the entire printer and/or associated machinery may be put on a shelf with a shelf immediately there above. The opening of the exit hopper towards the operator has the advantage of saving space, in that apparatus, books or the like may be placed on the shelf immediately above the printer without affecting the ability to remove printed materials therefrom. Note in FIG. 1B that side 46 may be hinged to the printer body and swung outwardly to the right as shown by arrow 59 so that it separates from the main body of the printer along line 59' to expose the inner workings 60 of the printer for permitting change of printer parts and to facilitate jam removal. These inner workings may include a stationary ribbon cartridge 61 and a relatively heavy carriage and ribbon drive motor assembly 63 that contributes to the bottom weighting of the unit.

Referring now to FIG. 2 the swingable side portion 36 is shown to be hingedly attached to the printer. Side 36 has a channel or slot 62 adapted to accommodate cut sheets of paper which slot is also made up of a side wall 64 in the interior of printer 10 which will be as described hereinafter.

The input hopper constitutes the opposed sidewalls 63 and 64, along with interior side walls 66 and 66' which exist at each end of slot 30 formed when swingable side 36 is moved to the right in a closed position.

Also shown in this figure is a spring loaded member 70 which is secured at a point 72 to frame 74 to which side 36 is attached. The configuration is such that as side 36 is closed, spring member 70 produces a pressure in the direction of arrow 76 so that any paper between spring member 70 and picker roller 80 is pressed to the picker roller. Also, paper which exists within the input hopper comes to rest against the bottom thereof which has two upstanding corner tabs 84 to retain the paper in the hopper until such time as the picker roller is actuated.

Figure 3:
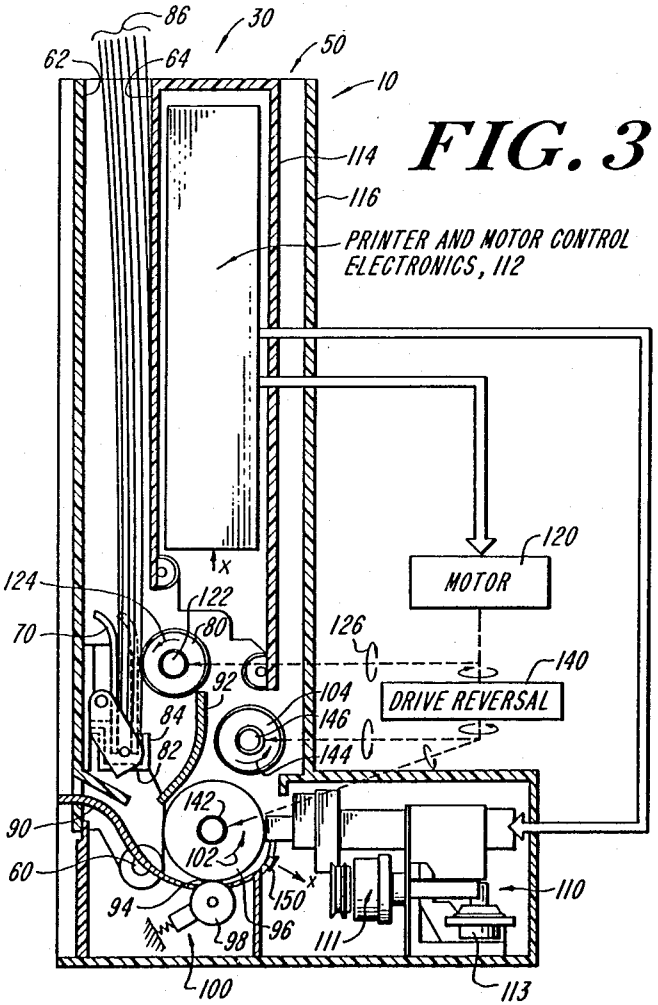
FIG. 3 is a cross sectional and diagramatic view of the subject free-standing vertical printer illustrating the stacking of paper in the input hopper, along with the mechanical drive for the picker and exit rollers as well as the platen, in which the printing apparatus and platen drive are illustrated as being at the bottom of the unit to promote stability.

Referring now to FIG. 3, in which reference characters contained therein refer to like elements of FIGS. 1 and 2, printer 10 is seen to house cut sheets 86 between spring member 70 and picker roller 80 which are kept in place by tabs, as discussed herein.

As can be seen a curved guide member 90 is positioned beneath the hopper and a further guide 92 is provided so that a paper within the input hopper is directed into the nip 94 between a platen 96. An associated pinch roller 98 may have a braking mechanism generally indicated by reference character 100 which restricts free motion of the platen unless the platen is driven in the direction illustrated by arrow 102. Alternatively, a separate drive motor may be coupled to the platen which prevents platen movement until this motor is actuated. In another embodiment there is enough inertia or friction in the mounting of the platen to keep it stationary unless driven. All of the above permit paper squaring in the nip between platen and associated roller.

Figure 6:
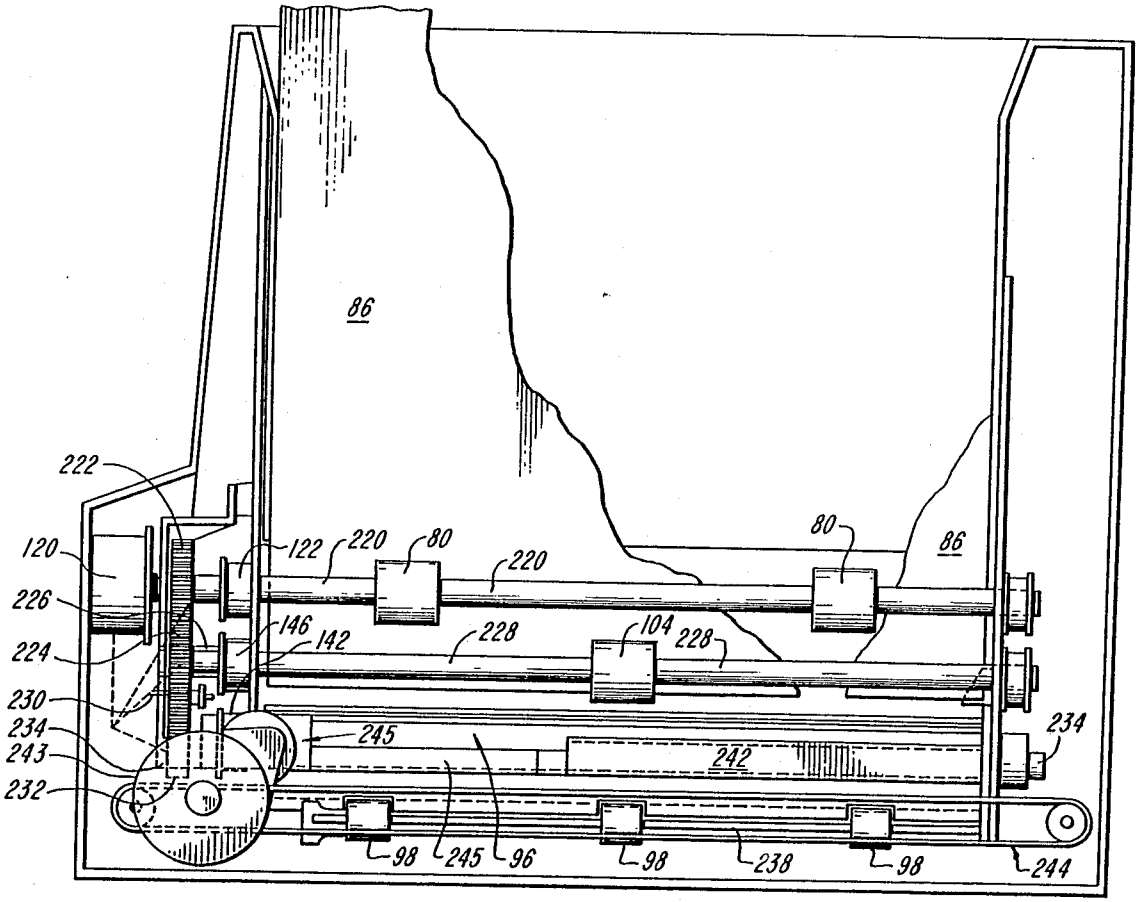

Immediately above the platen is an exit roller 104 which, as will be seen, drives the printed material into the exit hopper after having been printed by a heavy, bottom weighting printing mechanism generally illustrated by apparatus 110 which may include a ribbon drive assembly 111 and a ribbon drive gear 113. In the illustrated embodiment an impact printer utilizes the platen as an anvil. Printer 110 is driven by printer and motor control electronics 112 housed between the input and exit hoppers, with the exit hopper being defined by side walls 114 and 116, with wall 116 forming an outer portion of the printer housing. The printer mechanism is generally housed in the L-shaped bottom portion of the printer as well as a motor 120 which, as illustrated in FIG. 6 can be seen positioned at the bottom of the free-standing vertically-oriented unit. In one embodiment motor 120 is a relatively heavy bidirectional stepper motor under the control of printer and motor control electronics 112, the weight of which contributes to the stability of the printer because of its location at the bottom of the unit.

It will be appreciated that the electronics for driving motor 120 and printer 110 are relatively light and therefore can be located relatively high with respect to the printer body without significantly affecting the center of gravity of the printer. With the printing mechanism motor being located at the bottom of the unit, exceptional stability is provided for the subject printer due to the bottom weighting provided. Note that heavier components may be located at the bottom of the circuit board to lower the center of gravity of the unit, whereas any transformers utilized may be mounted in the base of the printer for bottom-weighting purposes.

In one embodiment motor 120 drives picker roller 80 through a one way clutch 122 so that picker roller 80 is driven in the direction of arrow 124 for rotation of the shaft coupled to the clutch in the direction of arrow 124 for rotation of the shaft coupled to the clutch in the direction of arrow 126. Otherwise, for a counter rotation of motor 120, picker roller 80 is free wheeling.

A drive reversal unit 140 is attached to the motor of 120 such that when picker roller 80 is driven in the direction of arrow 123, exit roller 104 is free wheeling and the platen 96 is braked to a stop via the brake action on picker roller 98 or by friction or inertia. Reversal of motor 120 drives platen 96, via its associated one way clutch assembly 142 in the direction of arrow 102, whereas the same motor direction drives exit roller 104 in the direction of arrow 144 via a one way clutch 146. The three one way clutches utilized in one embodiment of this invention are more fully described in connection with FIG. 6.

For the printer and motor control electronics to operate properly a paper sensor 150 is located through guide 90 so that the beginning and end of cut paper passing around platen 96 may be sensed, with the printer 110 being actuated conventionally by electrics 112. Additionally, motor 120 upon the sensing of paper at sensor 150 may be driven in a different fashion to provide for appropriate printing via printer 110.

Figure 4A:
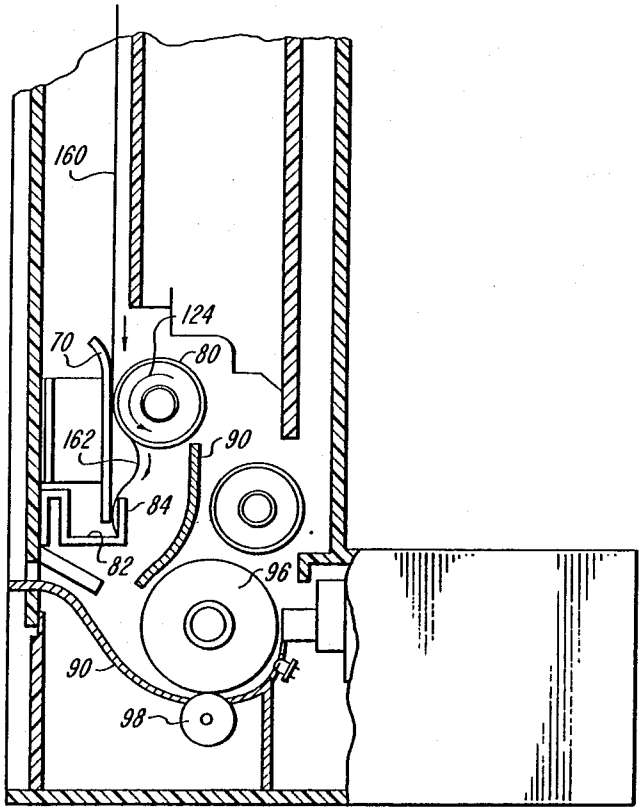
FIGS. 4A, 4B and 4C illustrate the movement of a cut sheet of paper from the input hopper down through the nip between the platen and the pinch roller and up past the exit roller where it is deposited in the exit hopper.
Figure 4C:
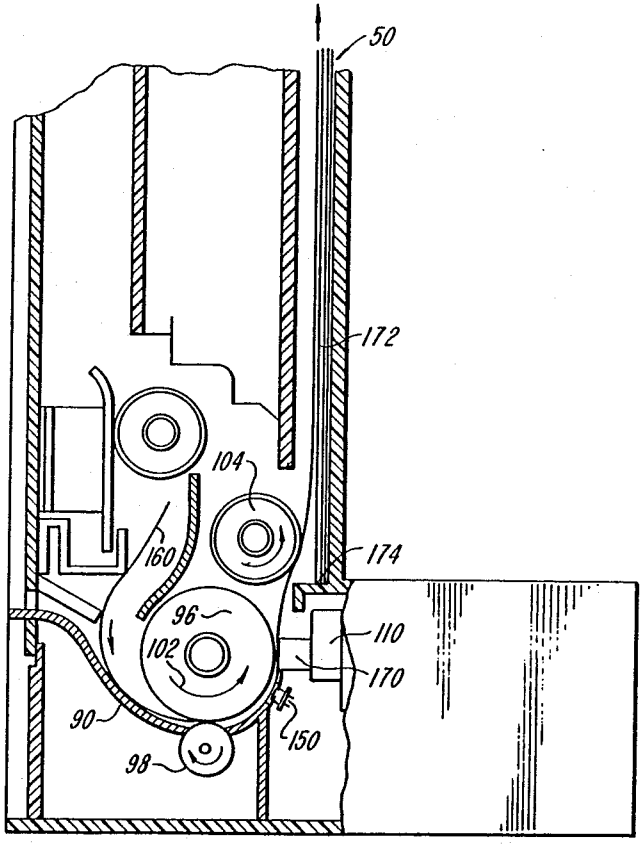
Figure 4B:
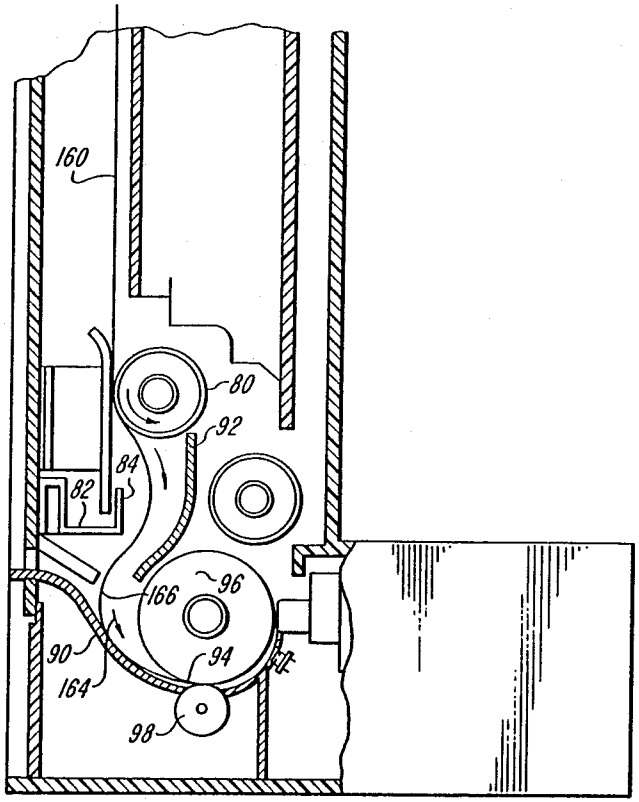

Referring now to FIGS. 4A through 4C, the paper path through the printer is now described. As can be seen, originally picker roller 80 is driven in the direction of arrow 124 such that sheet 150 buckles at a point 162 due to corner tab 84. This can be clearly seen in FIG. 4A. The purpose of the tab, as is conventional, is to assure that one and only one sheet is picked at a time.

Referring now to FIG. 4B the picked sheet 160 is driven to the nip 94 between platen 96 and pinch roller 98 so as to urge the paper in the direction of arrow 164, with roller 80 and guide 90 cooperating to drive the paper into the nip as indicated by the bulge of the paper at 166.

Since picker roller 80 is driven by a predetermined amount due to the delivery of a predetermined number of pulses to stepper motor 120, upon the stepping of a predetermined amount, bidirectional motor 120 is reversed, and as illustrated in FIG. 4C platen 96 turns in the direction of arrow 102 to drive paper 160 by the print head portion 170 of printer 110, with the printer having been actuated by virtue of passage of paper past sensor 150. It can be seen here that the paper is curved by the curvature of guide 90 and its cooperation with platen 96 such that it continues to curve upwardly where it meets with exit roller 104 such that it is driven into exit hopper 50 where other cut sheets 172 are already shown as residing within the hopper and standing upwardly on the bottom portion 174 of the exit hopper in a FIFO order. It will be noted that the pressure produced by brake 100 of FIG. 3 is not sufficient to affect the movement of roller 98 or platen 96 in the driven direction.

The purpose of the brake, if used, is to provide a stationary nip into which the paper can be driven so as to square up the paper. The braking mechanism also serves to stabilize the line position of the printing process. The stationary nip can also be provided by a separate motor and drive or by the inertia of a stationary plate itself.

It will be appreciated that while an impact printer is illustrated in this embodiment, any type of printing mechanism may be utilized including electrostatic printheads, thermal printheads and ink jet printheads which may be utilized either at platen 96 or between platen 96 and the exit hopper.

In one embodiment the side surface 46 of the unit is swingable which provides access not only to any paper jams which may occur but also access to the printer mechanism such that the printing font, daisy wheel, matrix, thermal print head, or ribbon may be changed at a convenient location to the operator.

Figure 5A:
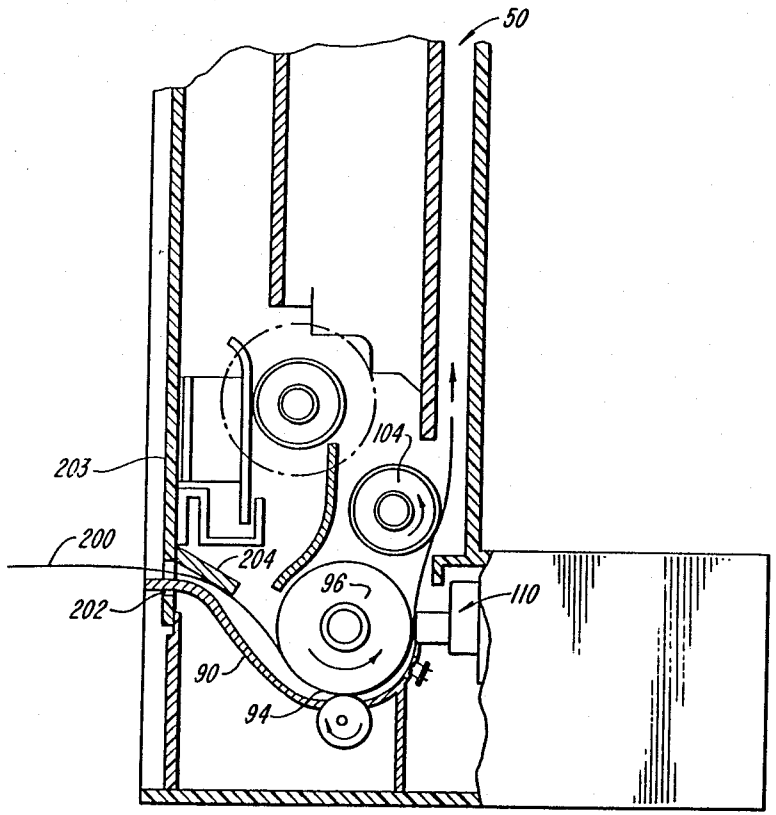
FIG. 5A and 5B illustrate an alternative paper path through the subject vertically-oriented printer, in which the paper enters from the left and proceeds to the nip between the platen and its associated pinch roller; and, FIG. 6 is a side view of the subject printer showing a single drive motor and the use of three unidirectional clutches.
Figure 5B:
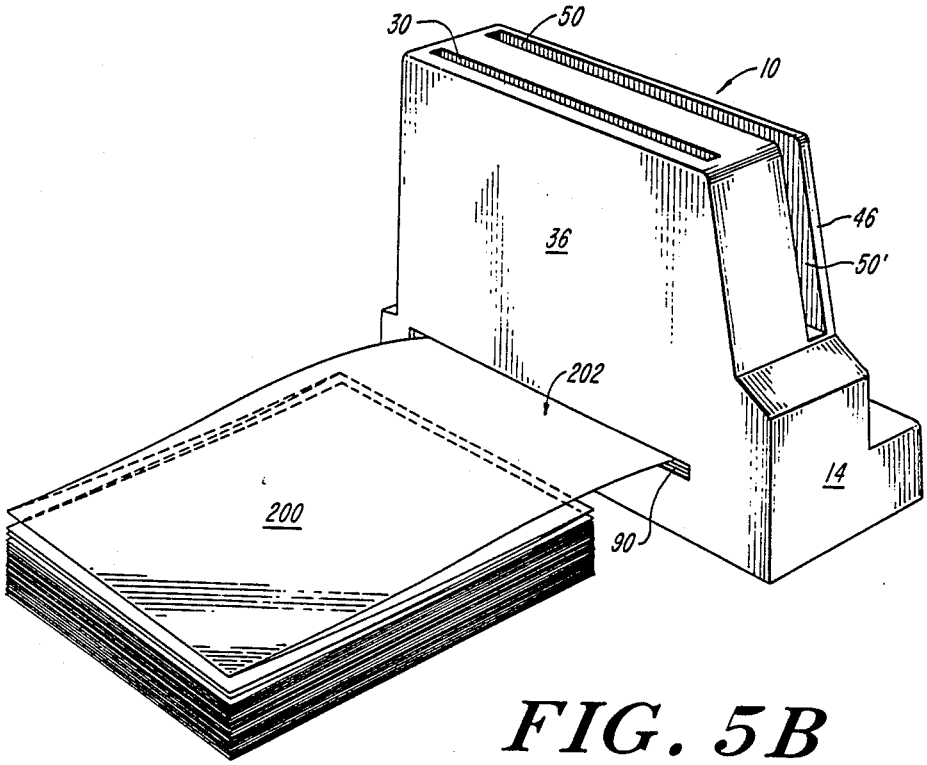

Referring now to FIGS. 5A and 5B, an optional alternative paper path is illustrated by the path of paper 200 through s slot 202 in sidewall 203 of the printer body. Here a top guide 204 insures that the paper is guided towards nip 94 where it passes around platen 96 and is picked up by exit roller 104 and moved into exit hopper 50. It will be appreciated that this alternative paper path is useful when continuous sheets, either fan-folded or sprocket-driven, are to be utilized in the printing process. It is also possible to utilize this alternative paper path should there be a malfunction of the input hopper assembly such that printing can nonetheless occur regardless of such malfunction, a so called "limp mode" operation.

Referring now to FIG. 6, motor 120 is shown to be housed within the printer body with its output shaft directly driving unidirectional clutch 122 which is in turn coupled to a picker roller drive shaft 220 which drives an exit roller shaft 228 which cooperates with a drive gear 224 which is located on a shaft 226 coupled to unidirectional clutch 146 which drives an exit roller shaft 228 which exit roller 104 is fixedly attached. Gear 224 drives an idler gear 230 which in turn drives a drive gear 232 which is attached to the shaft 234 of unidirectional clutch 142 which drives the platen 96. As can be seen, pinch rollers 98 are located along a shaft 238.

A print head carriage generally indicated at 240 carries the conventional stationary ribbon cassette 242. A ribbon 245 from the cassette is pulled out and pushed back in by the print carriage drive motor 243 through carriage belt 244 and a gear train (not shown). All of the apparatus is typically heavy and is mounted at this base of the printer for stability.

As can be seen in this manner the single motor 120 operates as illustrated in FIG. 3 to drive the respective rollers and platen in the required directions. It will also be appreciated that other drive mechanisms may be utilized, including a separate drive motor for platen 96.

From the foregoing, it will be appreciated that the self-supporting, self-contained vertical printer hereof has an input hopper with laterally spaced, substantially vertically extending generally parallel walls 63 and 64 and an exit hopper having similar walls and which walls have a longitudinal extend in a direction front-to-back parallel to said walls sufficient to accommodate paper sheets having a predetermined width. The width dimension is the dimension transverse to the plane parallel to the hopper walls and against which faces of the sheets of paper rest when inserted into the hoppers. As can be seen in FIG. 3, the housing has a height dimension greater than its width dimension, with the width, dimension being the dimension transverse to a plane parallel to the hopper walls. It will also be observed from a review of FIG. 1A, as well as FIG. 2, that the width dimension is smaller than the width of the sheets of paper. It will also be seen from a review of FIG. 2 that the long direction of the rectilinear hoppers is in the generally vertical direction.

Having above indicated a preferred embodiment of the present invention, it will occur to those skilled in the art that modifications and alternatives can be practiced within the spirit of the invention. It is accordingly intended to define the scope of the invention only as indicated in the following claims.

We claim:

1. A self-supporting vertical printer comprising:

a unitary housing having a pair of vertically-oriented, laterally spaced-apart, generally parallel input and exit paper hoppers each having a slot in the top surface of said housing, each hopper being a substantially enclosed cavity defined at least in part by a pair of laterally spaced substantially vertically extending generally parallel walls and having a longitudinal extent in a direction front to back parallel to said walls sufficient to accommodate generally vertically disposed paper sheets having a predetermined width, said housing having a height greater than its width with the width being the dimension transverse to a plane parallel to said hopper walls, such that faces of sheets of paper rest against one of the walls of each said hopper when inserted into said hoppers, said width dimensioned to be smaller than the longitudinal extent of said hoppers; and a printing means for selectively printing on said sheets and disposed in the bottom of said unitary housing for bottom weighting.

2. The printer of claim 1 wherein said vertical printer has a generally L-shaped body with a vertical portion and a horizontal portion extending from the bottom of said vertical portion, and wherein the printing means is located in said horizontal portion to add stability to the printer through the bottom-weighting thereof, with the L-shaped body having a removable side portion for permitting easy removal of the printing means contained therein or easy access to changeable printing parts, and for jam clearing.

3. The printer of claim 1 wherein said vertical printer has a generally L-shaped housing with a vertical portion and a horizontal portion extending horizontally from the bottom of said vertical portion, and further including electronic apparatus positioned between the laterally spaced apart hoppers, said hoppers and said electronic apparatus being located in said vertical portion and said printing means being located in said horizontal portion, said electronic apparatus being less in weight than the bottom-weighting provided by the printing means in the horizontal portion of said printer, such that a stable and convenient location for the electronic drive apparatus for the printer is established.

4. The printer of claim 1 including a second exit slot associated with the exit hopper opening through a side face of the printer whereby paper may be removed from the exit slot through either of said top surface exit slot or said second exit slot through the side face of the printer.

5. The printer of claim 1 wherein said printer has a platen, an associated pinch roller at the bottom thereof, and a paper path from said input hopper to said platen, and further including an alternative paper path which bypasses the paper path from the input hopper to said platen, said alternative paper path including a slot in the side wall of said printer and guide means from said slot to the nip between said platen and said associated pinch roller.

6. The printer of claim 5 wherein said printer has an exit roller, and wherein said guide means is curved so as to force said paper around said platen and up to said exit roller.

7. The printer of claim 1 wherein said input hopper includes corner tabs and a cavity adapted to receive cut sheets of paper, a picker roller, means for urging said paper against said picker roller, and curved guide means for curving said paper as it is picked from the input hopper, said picker roller moving paper downwardly into said corner tabs such that one sheet is picked at a time, said printer including a platen and an associated pinch roller forming a nip therebetween, said guide means being curved such that the paper picked by said picker roller is curved by said guide means to the nip between said platen and said pinch roller, said printer also including an exit roller, with said guide means being curved past said platen such that paper passing said platen is curved upwardly in a substantially vertical direction towards said exit roller.

8. The printer of claim 7 and further including a motor having a bi-directional capability for driving said picker roller, said exit roller and said platen, uni-directional clutch means having input shafts thereof directly coupled to said bi-directional motor and having respective output shafts coupled to the drive shafts for said picker roller, said platen and said exit roller, such that no belt drive means are utilized in the driving of said rollers or said platen.

9. The printer of claim 1 wherein said input hopper includes a picker roller adjacent thereto, and further including a swingable side portion forming a wall of said input hopper which in its open position permits the insertion of paper into said input hopper and which in its closed position urges said paper towards said picker roller.

10. The printer of claim 1 and wherein the exit hopper of said printer has a hinged face to permit access to the interior of said printer for reasons of ribbon and print head change plus jam clearing if required.

11. The printer of claim 1 wherein said printer includes a platen and an exit roller adjacent said exit hopper and further including a paper edge sensor between said platen and said exit roller, and means responsive to said sensor output for actuating said printing means.

12. The printer of claim 1 and further including an angled control panel located at the front of said printer, said printer including at least one push button control switch mounted on said angled control panel, the angle of said control panel being such that depression of said switch will not cause the printer to move backwards.

13. A printer according to claim 1 wherein each of said hoppers is generally rectilinear and has its long dimension in a generally vertical direction and a vertical extent at least as great as the major portion of the length of the paper sheets.

14. A freestanding printer comprising:

a unitary housing having means defining two adjacent spaced-apart vertical hoppers for holding a number of generally vertically disposed rectilinear cut sheets of paper, one of said hoppers being an input hopper and the other being an exit hopper, each hopper being a rectilinear cavity with each hopper cavity having an associated slot through the top portion of said housing, said exit hopper having its associated slot also opening through the front face of said printer, said housing have a height greater than its width with the width being the dimension transverse to a plane parallel to said input hopper;

printing means for selectively printing on said sheets located in the bottom of said housing including a platen and an associated pinch roller located adjacent said platen, guide means for guiding said sheets of paper along a predetermined path from said input hopper to the nip between said platen and said associated pinch roller, a picker roller for moving paper out of said input hopper, and an exit roller positioned between said platen and said exit hopper for driving printed paper into the said exit hopper; and means defining an alternative paper path through said printer and including an additional slot in one side of said housing, and means for guiding paper from said additional slot to the nip between said platen and said pinch roller.

15. The printer of claim 14 and further including paper edge sensing means positioned between said platen and said printing means for sensing the beginning and end of cut sheets of paper from said input hopper.

16. The printer of claim 14 wherein said housing is generally L-shaped in configuration having vertical and horizontal portions, respectively, and wherein said printing means is located in the horizontal portion of said housing.

17. The printer of claim 14 and further including electronic circuit boards mounted between said spaced-apart hoppers, said printed circuit boards and the components thereon being of negligible weight as compared to the weight of said printing means, whereby the stability of said printer is not affected by the provision of electrical control apparatus for said printer.

18. The printer of claim 14 wherein said printing apparatus includes an impact printer, the weight of said impact printer being such as to bottom weight said freestanding printer. thereby stabilizing said printer against the motion of said printing means, said impact printer including a carriage, a ribbon, and a printing head movable transversely on said carriage, said carriage being positioned such that said ribbon and print head are actuatable to print paper positioned between said print head and said platen, said platen serving as an anvil for said impact printer.

19. The printer of claim 14 and further including bi-directional motor drive means for driving said picker roller, said platen and said exit roller, and uni-directional clutch means interposed between said rollers and said motor means and between said platen and said motor means such that in one direction said bi-directional motor drives said picker roller, whereas in the other direction said bi-directional motor drives said platen and said exit roller.

20. A freestanding printer comprising:

a unitary housing having means defining two adjacent spaced-apart vertical hoppers for holding a number of vertically disposed rectilinear cut sheets of paper, one of said hoppers being a input hopper and the other being an exit hopper, each hopper being a rectilinear cavity with each hopper cavity having an associated slot through the top portion of said housing, said housing having a height greater than its width with the width being the dimension transverse to a plane parallel to said input hopper;

printing means in the bottom of said housing including a platen and an associated pinch roller located adjacent said platen, guide means for guiding said sheets of paper along a predetermined path from said input hopper to the nip between said platen and said associated pinch roller, a picker roller for moving paper out of said input hopper, and an exit roller positioned between said platen and said picker roller for driving printed paper into the said exit hopper; and means defining an alternative paper path through said printer and including an additional slot in one side of said housing, and means for guiding paper from said additional slot to the nip between said platen and said pinch roller.

21. A freestanding printer comprising:

a unitary housing having means for holding a number of generally vertically disposed rectilinear cut sheets of paper comprising two adjacent laterally spaced-apart, generally vertically extending paper hoppers extending generally parallel one to the other, each hopper being defined at least in part by a pair of laterally spaced, substantially vertically extending, generally parallel walls, each hopper having a rectilinear cavity defined in part by said laterally spaced walls and having an associated slot through a top portion of said housing extending longitudinally generally parallel to said walls, said housing having a height greater than its width with the width being the dimension transverse to a plane parallel to said hopper walls against which faces of said cut sheets rest when inserted into said hoppers;

printing means for selectively printing on said sheets and disposed in the bottom of said housing; and means for minimizing the amount of surface area required to support said housing at its bottom comprising said width dimensioned to be smaller than the longitudinal extent of said slots.

22. The printer of claim 21 wherein said printer has a generally L-shaped housing with vertical and horizontal portions, respectively, said horizontal portion extending from the bottom of said vertical portion, said hoppers and said electronic control circuitry being located in said vertical portion and said printing means being located in said horizontal portion.

23. The printer of claim 21 including a second entrance slot opening through a side face of the printer whereby paper may be fed from said entrance slot or said entrance hopper to said exit hopper.

24. The printer of claim 21 wherein said printer has a platen, an associated pinch roller at the bottom thereof, and a paper path from said input hopper to said platen, and further including an alternative paper path which bypasses the paper path from the input hopper to said platen, said alternative paper path including a slot in the side wall of said printer and guide means from said slot to the nip between said platen and said associated pinch roller.

25. The printer of claim 24 wherein said printer has an exit roller, and wherein said guide means is curved so as to force said paper around said platen and up to said exit roller.

26. The printer of claim 24 wherein said input hopper includes corner tabs and a cavity adapted to receive cut sheets of paper, a picker roller, means for urging said paper against said picker roller, and curved guide means for curving said paper as it is picked from the hopper, said picker roller moving paper downwardly into said corner tabs such that one sheet is picked at a time, said printer including a platen and an associated pinch roller forming a nip therebetween, said guide means being curved such that the paper picked by said picker roller is curved by said guide means to the nip between said platen and said pinch roller, and said printer also including an exit roller, with said guide means being curved past said platen such that paper passing through said platen is curved upwardly in a substantially vertical direction towards said exit roller.

27. The printer of claim 26 and further including a motor having a bi-directional capability for driving said picker roller, said exit roller and said platen, uni-directional clutch means having input shafts thereof directly coupled to said bi-directional motor and having respective output shafts coupled to drive shafts for said picker roller, said platen and said exit roller, such that no belt drive means are utilized in the driving of said rollers or said platen.

28. The printer of claim 21 wherein said printing apparatus comprises an impact printer, including a carriage, a ribbon, and a print head movable transversely on said carriage, said carriage being positioned such that said ribbon and print head are actuatable to print paper positioned between said print head and said platen, said platen serving as an anvil for said impact printer, the weight of said impact printer being such as to bottom weight said freestanding printer, thereby stabilizing said printer against the motion of said printing apparatus.

29. A freestanding printer comprising:

a generally L-shaped unitary housing with vertical and horizontal extending portions, respectively, and having means including two laterally adjacent spaced-apart vertical hoppers extending generally parallel to one another in the vertically extending housing portion of said L-shaped housing for holding a number of generally vertically disposed cut sheets of paper, each hopper being defined at least in part by a pair of laterally spaced, substantially vertically extending, generally parallel walls, each hopper having a rectilinear cavity defined in part by said laterally spaced walls and having an associated slot through the top portion of said housing, said housing having a height greater than its width with the width being the dimension transverse to a plane parallel to said hopper walls against which faces of said cut sheets rest when inserted in one of said hoppers; and printing means for selectively printing on said sheets and disposed in the bottom of the horizontally extending housing portion of said L-shaped housing.

30. The printer of claim 29 including a second exit slot associated with the exit hopper opening through a side face of the printer whereby paper may be removed from the exit slot through either of said top surface exit slot or said second exit slot through the side face of the printer.

31. The printer of claim 29 wherein said printing means includes a platen, an associate pinch roller adjacent the platen and the bottom of the housing, and a paper path from said input hopper to said platen, and further including an alternative paper path which bypasses the paper path from the input hopper to said platen, said alternative paper path including a slot in the side wall of said printer and guide means from said slot to the nip between said platen and said associated pinch roller.

32. The printer of claim 31 wherein said printer has an exit roller, and wherein said guide means is curved so as to force said paper around said platen and up to said exit roller.

33. The printer of claim 29 wherein said input hopper includes corner tabs and a cavity adapted to receive cut sheets of paper, a picker roller, means for urging said paper against said picker roller, and curved guide means for curving said paper as it is picked from the hopper, said picker roller moving paper downwardly into said corner tabs such that one sheet is picked at a time, said printer including a platen and an associated pinch roller forming a nip therebetween, said guide means being curved such that the paper picked by said picker roller is curved by said guide means to the nip between said platen and said pinch roller, said printer also including an exit roller, with said guide means being curved past said platen such that paper passing through said platen is curved upwardly in a substantially vertical direction towards said exit roller.

34. The printer of claim 32 and further including a motor having a bi-directional capability for driving said picker roller, said exit roller and said platen, uni-directional clutch means having input shafts thereof directly coupled to said bi-directional motor and having respective output shafts coupled to drive shafts for said picker roller, said platen and said exit roller, such that no belt drive means are utilized in the driving of said rollers or said platen.

35. A printer comprising a unitary housing, said housing comprising first, second and third substantially rectangular portions, said first housing portion comprising a print head and means for driving said print head, said second housing portion comprising a platen and an associated pinch roller located adjacent said platen, said first and second housing portions positioned adjacent one another in a common base, said third housing portion comprising adjacent separate, spaced-apart, input and output hoppers, said input and output hoppers having their long dimensions in a generally vertical direction with an associated input slot and an output slot respectively positioned at the top of said third housing portion, a further input slot positioned in the side of said second housing portion, common guide means for guiding paper from said input hopper or said further input slot to the nip between a paper input side of said plate and said associated pinch roller for printing by said print head on an output side of said platen, a picker roller positioned above said platen and said further slot for moving paper out of said input hopper to said common guide means, and an exit roller positioned above said platen for moving paper after such printing to said output hopper, said input hopper and picker roller being substantially vertically aligned with said input side of said platen, said output hopper and exit roller being substantially vertically aligned with said output side of said platen, means for maintaining the stability of said printer despite orientation of the long dimension of said input and output hoppers in a vertical direction comprising dimensioning the positioning of said print head and platen in said first and second housing portions with respect to said third housing portion to maintain a low center of mass.

36. A self-supporting vertical printer comprising:

a unitary housing having a pair of generally vertically-disposed, laterally spaced-apart, generally parallel input and exit paper hoppers each having a slot in the top surface of said housing, each hopper being defined at least in part by a pair of laterally spaced substantially vertically extending generally parallel walls, said walls being generally parallel to side surfaces of said housing, said side surfaces joining a front surface and a back surface, means including controls on the front surface for operating said printer with said hoppers vertically disposed comprising said housing having a height dimensioned to be greater than its width with the width being the dimension transverse to a plane parallel to said hopper walls against which faces of sheets of paper rest when inserted into said hoppers; said width dimensioned to be smaller than the width of said sheets of paper; and printing means disposed at the bottom of said housing for bottom weighting, and means for moving paper from said input paper hopper downward to said printing means for printing and then upward to said exit paper hopper, said front surface comprising a width by height dimension of said housing.

37. An arrangement according to claim 36 wherein said exit paper hopper further comprises a frontal slot to permit paper withdrawal either from the front or the top surface of said housing.

38. An arrangement according to claim 36 further comprising an entrance slot for receiving fan-fold paper, said entrance slot being located in a side of said housing, said side comprising a height by depth dimension of said housing.

* * * * *